United States Patent [19]

Cain et al.

[11] 4,265,203

[45] May 5, 1981

[54] GOVERNOR CONTROL HAVING DUAL POWER SETTINGS

[75] Inventors: Donald E. Cain, Peoria, Ill.; Nathan Gutman, Simsbury, Conn.

[73] Assignee: Caterpillar Tractor Co., Peoria, Ill.

[21] Appl. No.: 11,989

[22] Filed: Feb. 14, 1979

[51] Int. Cl.[3] ..... F02D 1/04

[52] U.S. Cl. ..... 123/367

[58] Field of Search ..... 123/140 R, 140 FG, 140 CC, 123/140 MC, 341, 383, 382, 363, 367; 74/860

[56] References Cited

U.S. PATENT DOCUMENTS

| | | | |
|---|---|---|---|
| 3,145,624 | 8/1964 | Parks et al. | 123/140 FG X |
| 3,554,059 | 1/1971 | Parks et al. | 74/860 |
| 4,068,642 | 1/1978 | Little | 123/140 FG X |
| 4,149,507 | 4/1979 | Little | 123/140 FG |

*Primary Examiner*—Harry N. Haroian
*Attorney, Agent, or Firm*—John W. Grant

[57] ABSTRACT

A governor (10) for an internal combustion engine has a resiliently biased flyweight influenced reciprocating member (26) for controlling the supply of fuel pumped to the engine. A means (39) is connected to the member (26) and is rotatable between a first position at which a first adjusting screw (42) is positioned for engagement with a first stop means (28) for establishing a first power setting of the engine and a second position at which a second adjustable screw (43) is positioned for engagement with a second stop means (29) for establishing a second power setting of the engine. The first and second stop means (28,29) are yieldable to control the lug characteristic and torque rise of the engine.

8 Claims, 5 Drawing Figures

51
46
III
III
52
49
47
48
39
56
54
58
56
53
57
41
II
42
43
II
44
29
28
31
32
33
33
37
38
34
36
10
27
26
22
23
13
24
21
16
16
14
19
18
17
X
11
12

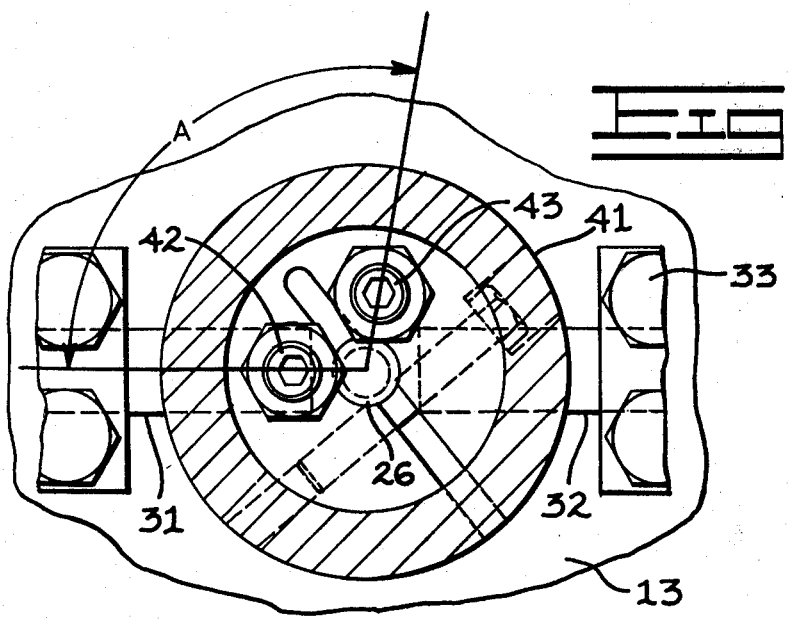
Fig. 2
Fig. 3
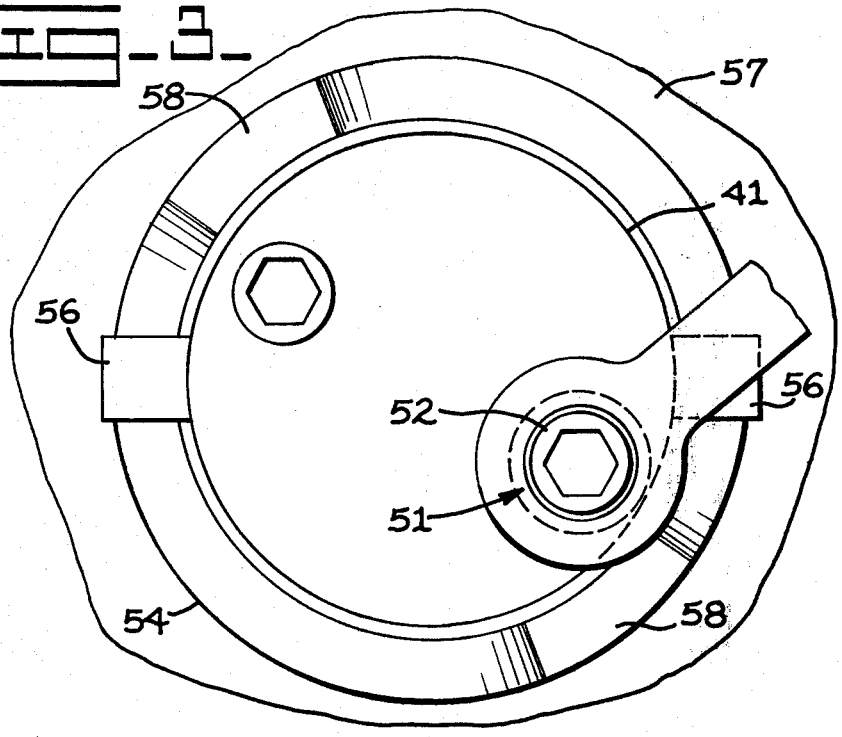

GOVERNOR CONTROL HAVING DUAL POWER SETTINGS

TECHNICAL FIELD

This invention relates to a governor control having dual power settings with a particular lug characteristic or torque rise of the engine being established at each of the power settings.

BACKGROUND ART

Many vehicles such as farm implements and earth-moving equipment have governor regulated engines. The governor is usually employed to establish normal operating speed and maximum power output of the engine. The governor of some such vehicles is provided with a variable governor control with which the power setting of the governor is automatically adjusted in response to drive ratio selection in the transmission. One such arrangement is disclosed in U.S. Pat. No. 3,554,059 issued to John H. Parks et al on Jan. 12, 1971.

One of the problems with such arrangement is that no means is provided to optimize the lug characteristic or torque rise for each of the power settings of the governor. This could result in inefficient burning of the fuel which might cause the emission of noxious exhaust emissions and smoke from the engine at one or more of the power settings. Torque rise is defined as the inherent increase in the output torque of the engine when the engine speed decreases from the full load or other preselected speed due to increased loading on the engine.

DISCLOSURE OF INVENTION

In one aspect of the present invention, a governor having a movable member for controlling the delivery of fuel to an engine and hence the operating power of the engine includes first and second stop means for establishing first and second power settings of the governor. At least one of the first and second stop means is yieldable under the influence of the governor for controlling the lug characteristic and torque rise of the engine. A means is connected to the movable member for selectively engaging said first and second stop means.

BRIEF DESCRIPTION OF DRAWINGS

FIG. 2 is a sectional view taken along line II—II of FIG. 1.

FIG. 3 is an elevational view as viewed along a plane indicated by line III—III in FIG. 1.

BEST MODE FOR CARRYING OUT THE INVENTION

Figure 1:
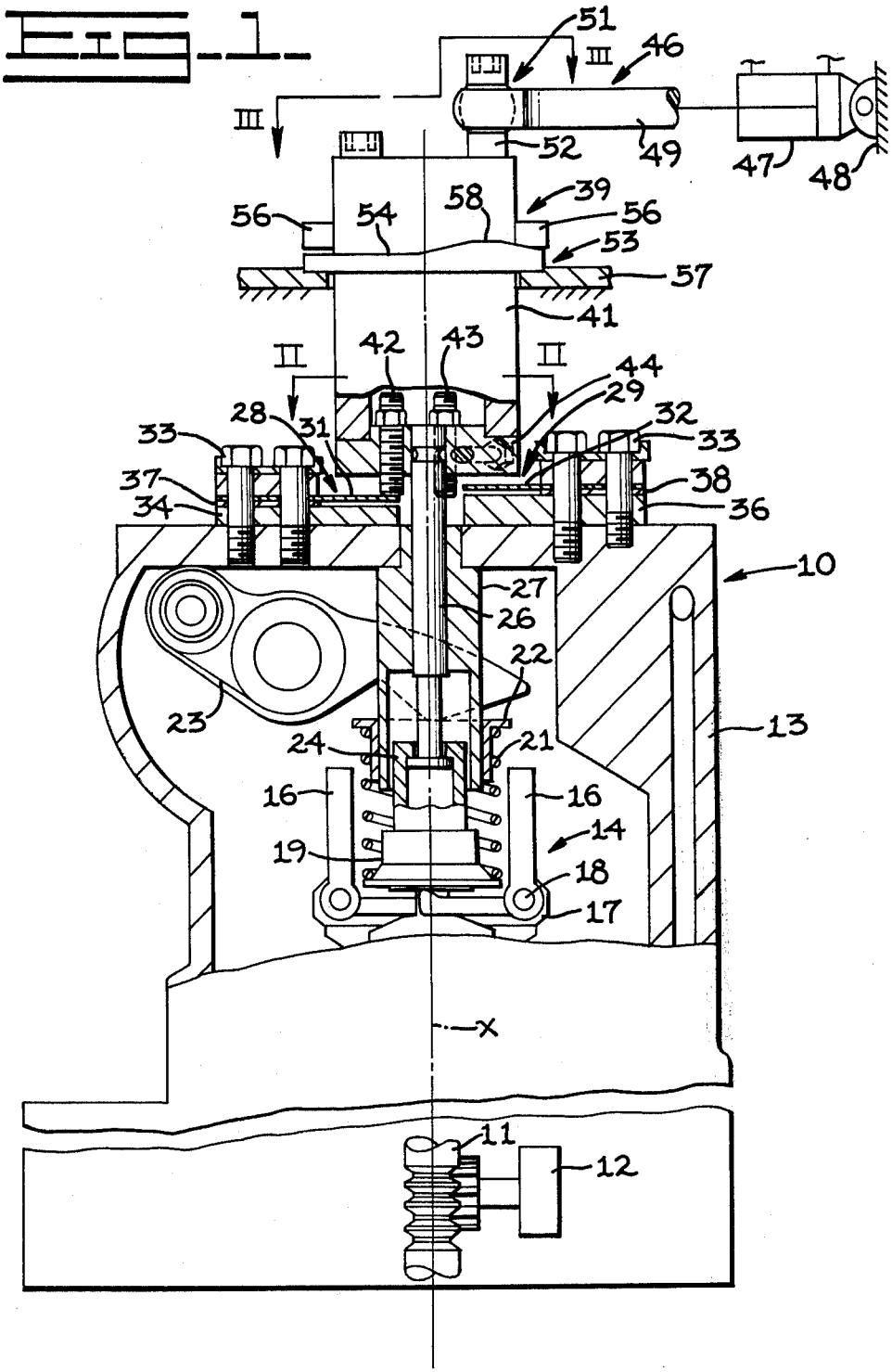
FIG. 1 is a diagrammatic sectional view of an embodiment of the present invention with portions shown schematically.

Referring to FIG. 1, an engine governor is generally indicated by the reference numeral 10 and is of the type taught in U.S. Pat. No. 3,145,624 which issued to J. H. Parks et al on Aug. 25, 1964. Such governor includes a flyweight influenced reciprocating member or rack 11 which is adapted to operate a plurality of fuel pumps, one of which is shown at 12. Each fuel pump 12 communicates pressurized fuel to a cylinder of an engine for regulating normal engine speed and power. The rack 12 is mounted in a governor housing 13 and is connected to a flyweight assembly 14. The flyweight assembly 14 is driven by the engine and includes a pair of flyweights 16 pivoted to a carrier 17 as at 18. Flyweights 16 swing outwardly in response to increase in engine speed and engage a thrust plate 19 which forms one seat for a governor spring 21. The other seat for governor spring 19 is a sliding collar 22 engaged by a lever 23. Lever 23 is manually adjustable by control means, not shown, disposed exteriorly of the housing for compressing the governor spring and thus increasing engine speed in a well known manner. An adapter 24 is associated with thrust plate 19 and is connected with a bar or member 26. Member 26 passes through a bearing sleeve 27 secured to governor housing 13 and is reciprocatable along the longitudinal axis "X" in concert with rack 11 in response to movement of adapter 24. Movement of member 26 in a downward or first direction increases the amount of fuel delivered to the engine while movement of member 26 in an upward or second direction decreases the amount of fuel delivered to the engine.

First and second stop means 28,29 are provided for establishing high and low power settings of the engine. The stop means can be, for example, a pair of yieldable spring blades 31,32 connected to governor housing 13 by bolts 33. A pair of spacers 34,36 and shims 37,38 are positioned between the respective spring blade and the end of governor housing 13. Preferably, spacer 34 is thinner than spacer 36 so that spring blade 31 is positioned closer to the end of governor housing 13 than spring blade 32.

A means 39 is connected to the protruding end of member 26 for selective engagement with spring blades 31,32. The means includes a cylindrical adapter case 41 connected to member 26 and first and second adjustable screws 42,43 threaded through an end plate 44 of adapter case 41. Adapter case 41 is rotatable about the axis "X" between a first position at which first adjustable screw 42 is positioned for engagement with blade spring 31 in response to movement of the member 26 in the first direction and a second position at which the second adjusting screw 43 is positioned for engagement with spring blade 32 in response to movement of member 26 in the first direction.

As shown in FIGS. 1 and 2, adjustable screw 43 does not engage spring blade 32 at the first position of the adapter case 41 and the first adjusting screw 42 does not engage blade spring 31 at the second position of adapter case 41.

In the embodiment shown, spring blades 31,32 are diametrically opposed while first and second adjusting screws 42,43 are angularly spaced one from the other at angle A. In this embodiment, angle A is about 100°. Thus the second position of adapter case 41 is obtained by rotating adapter case 41 clockwise about 80° from the position shown in FIG. 1, such position being the first position. However, the above-noted angles are not critical and can be varied as desired.

A means 46 is provided for rotating adapter case 41 between the first and second positions. The means can be, for example, a fluid motor 47 pivotally anchored to a stationary plate 48 and has its rod 49 connected at a swivel connection 51 to a pin 52 extending from adapter case 41.

Since the spring blade 31 is positioned closer to the governor housing 13 than spring blade 32, a means 53 is provided for moving adapter case 41 initially in a direction away from governor housing 13 and subsequently in a direction toward housing 13 in response to rotation of adapter case 41 from the first position to the second position. The initial movement movement of adapter case 41 lifts the adapter case and hence second adjusting screw 43 so that it clears spring blade 32 with the subsequent movement resulting in second adjusting screw 43 being set on spring blade 32.

Figure 4:
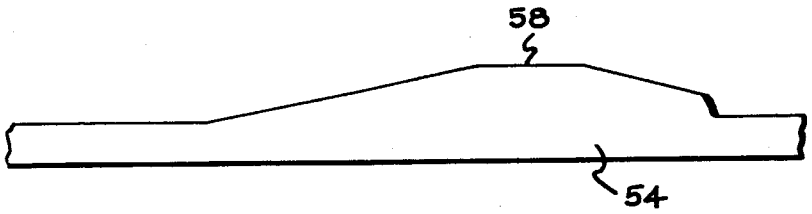
FIG. 4 is a profile of a cam race illustrated in FIG. 3.

The means 53 can be, for example, an annular cam race 54 circumscribing adapter case 41 and a pair of pins 56 secured to and extending outwardly from adapter case 41. The cam race is suitably secured to a plate 57 which is positioned stationary relative to governor housing 13. A flat development of a portion of the cam race 54 is illustrated in FIG. 4 showing one of a pair of lobes 58, the other lobe being positioned 180° from the lobe shown. The rise of the lobe is preferably selected to be slightly greater than the difference in height of spring blades 31,32.

Figure 5:
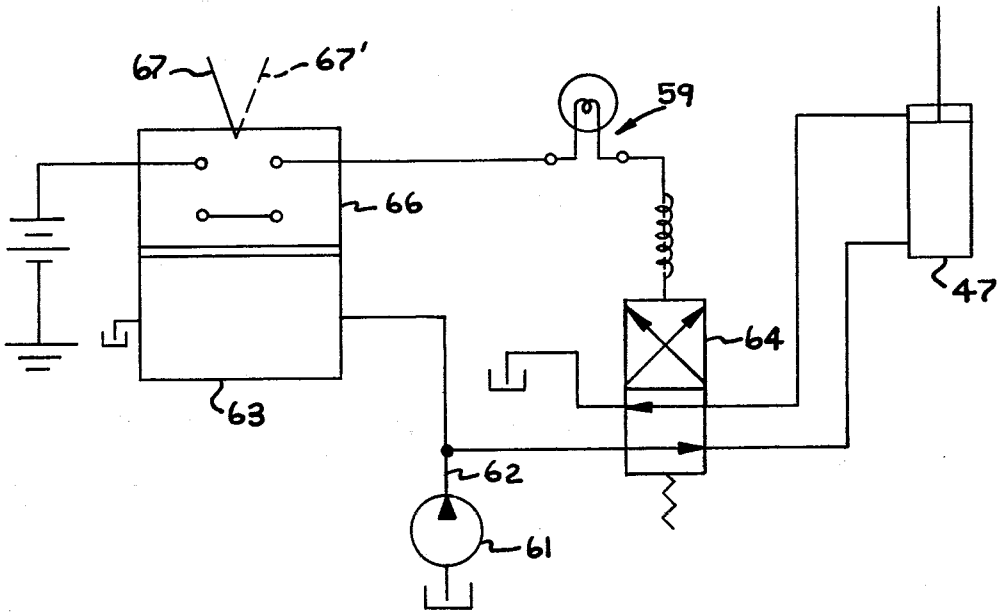
FIG. 5 is a schematic diagram of an electrically actuated hydraulic circuit to operate the present invention.

Referring to FIG. 5, a schematic electrohydraulic circuit 59 for actuating fluid motor 47 includes a pump 61 driven by the engine in the usual manner and which supplies pressurized fluid through a branched conduit 62, one leg of which is connected with a transmission 63. A solenoid operated valve 64 is positioned in the other leg and is shifted between a first position at which fluid is directed to the head end of fluid jack 47 and a second position at which fluid is directed to the rod end of fluid jack 47. The solenoid is operated by a switch 66 positioned to be closed by a transmission shift lever 67, preferably in response to the positioning of the transmission shift lever at a high speed ratio indicated by the broken line 67'. Closing the switch completes the circuit to the solenoid to shift valve 64 to the second position. Conversely, shifting transmission shift lever 67 to a low speed ratio causes switch 66 to open, resulting in valve 64 shifting to the first position.

INDUSTRIAL APPLICABILITY

In operation, adapter case 41 is normally positioned slightly outwardly from the position shown in FIG. 1, such position being controlled by governor 10 and hence movable member 26. When a load is imposed on the engine sufficient to cause a decrease in the rpm, governor 10 automatically moves rack 11 and adapter case 41 in the first direction to increase delivery of fuel to the engine. As adapter case 41 moves downwardly, eventually either first adjusting screw 42 will contact spring blade 31 or second adjusting screw 43 will contact spring blade 32 depending upon whether adapter case 41 is in the first or second position.

Assuming that adapter case 41 is in the first position, first adjusting screw 42 contacts spring blade 31 and will temporarily stop movement of adapter case 41 and hence member 26 and rack 11. This point is commonly referred to as the "full load condition" of the engine. As the engine rpm continues to decrease due to the load, the flyweight force continues to decrease such that governor spring 21 again causes rack 11, member 26, and adapter case 41 to move in the first direction against the resiliency of spring blade 31. Thus the resiliency of spring blade 31 will determine the lug characteristic or torque rise of the engine as the engine rpm decreases below the full load condition.

If adapter case 41 is in the second position, second adjusting screw 43 will engage spring blade 32. The position of spring blade 32 and length of second adjusting screw 43 are such that contact therebetween temporarily stops movement of adapter case 41, member 26, and rack 11 at a position prior to the engine reaching the previously described "full load condition", thereby establishing a second lower power setting. As with spring blade 31, the resiliency of spring blade 32 will establish the lug characteristic or torque rise of the engine at the second power setting.

With some engines the spring blade 31 can be replaced with a nonyieldable stop such that the natural torque rise of the engine is unchanged.

As previously noted, the position of adapter case 41 is established by the position of transmission shift lever 67. When the transmission shift lever is in the high speed ratio, adapter case 41 will be in the first position. If adapter case 41 is in the first position as shown in FIG. 1 and the transmission shift lever 67 is shifted to the low speed ratio, fluid is directed to the head end of fluid motor 47 thereby rotating adapter case 41 clockwise to the second position. Upon rotation of adapter case 41, pins 56 engage lobes 58 of cam race 54 and move the adapter case 41 in the second direction so that second adjusting screw 43 clears spring blade 32. As the pins 56 pass over lobes 58, adapter case 41 moves in the first direction so that second adjusting screw 43 is set on spring blade 32. Preferably, when adapter case 41 reaches the second position, a space will exist between pins 56 and cam race 54.

Should transmission shift lever be shifted from the low speed ratio to the high speed ratio with adapter case 41 at the second position, fluid is directed to the rod end of fluid motor 47 thereby rotating adapter case 41 counterclockwise to the first position. Rotation of adapter case 41 again causes pins 56 to engage lobes 58 of cam race 54 and lifts the second adjusting screw 43 clear of spring blade 32 and sets first adjusting screw 42 onto spring blade 31.

Other aspects, objects, and advantages of this invention can be obtained from a study of the drawings, the disclosure, and the appended claims.

We claim:

1. In a governor (10) having a governor housing (13) and a member (26) movable in the housing (13) for controlling the delivery of fuel to an engine and hence the operating power of the engine, the improvement comprising:

first and second stop means (28,29) connected to the housing (13) for establishing first and second power settings of the movable member (26) of the governor (10), at least one of said first and second stop means (28,29) being of a construction sufficient for yielding in response to the governor (10) for controlling the lug characteristic and torque rise of the engine; and means (39) connected to the movable member (26) and movable therewith for selectively engaging said first and second stop means (28,29) in response to said movable member (26) moving in an increased fuel direction.

2. The governor (10) of claim 1 wherein said at least one of said first and second stop means (28,29) including a spring blade (32) connected to said housing (13).

3. The governor (10) of claim 1 wherein said first and second stop means (28,29) each including a spring blade (41,42) connected to said housing (13).

4. The governor (10) of claim 1 wherein said means for selectively engaging said first and second stop means (28,29) includes an adapter case (41) connected to said movable member (26), first and second elements (42,43) connected to and extending from said adapter case (41), and means (46) for rotating said adapter case (41) relative to said housing (13) between a first position at which said first element (42) is positioned for engagement with said first stop means (28) and a second position at which said second element (43) is positioned for engagement with said second stop means (29).

5. The governor (10) of claim 4 including means (53) for moving the adapter case (41) and hence the movable member (26) axially in response to rotation of the adapter case (41) between said first and second positions.

6. The governor (10) of claim 5 wherein said means (53) for moving the adapter case includes an annular cam race (54) circumscribing the adapter case (41), said cam race having a lobe (58) thereon, and a pin (56) connected to and extending outwardly from said adapter case (41).

7. The governor (10) of claim 6 wherein said lobe has a rise sufficient for initially moving the adapter case (41) in a first axial direction for lifting one of said first and second elements (42,43) from the respective first and second stop means (28,29) and subsequently in a second axial direction for setting the other of said first and second elements (42, 43) onto the respective first and second stop means (28,29).

8. The governor (10) of claim 6 including a transmission shift lever (67), said means (46) for moving the adapter case (41) between said first and second positions including a fluid jack (47) connected to said adapter case (41), and means (59) for directing fluid to the head end of the fluid jack (47) in response to the transmission shift lever (67) being moved to first position and for directing fluid to the rod end of the fluid jack (47) in response to the transmission shift lever (67) being moved to a second position.

* * * * *